US006142340A

United States Patent [19]

Watanabe et al.

[11] Patent Number: 6,142,340

[45] Date of Patent: Nov. 7, 2000

[54] BEVERAGE DISPENSER

[75] Inventors: Hiroshi Watanabe; Hiroshi Kosaka, both of Saitama-ken, Japan

[73] Assignee: Sanyo Electric Co., Ltd., Osaka-fu, Japan

[21] Appl. No.: 09/384,401

[22] Filed: Aug. 27, 1999

[51] Int. Cl.[7] ..... B67D 5/08

[52] U.S. Cl. ..... 222/66; 222/214; 222/129.3

[58] Field of Search ..... 222/66, 207, 214, 222/129.3, 129.4

[56] References Cited

U.S. PATENT DOCUMENTS

| | | | |
|---|---|---|---|
| 4,271,987 | 6/1981 | Eriksson et al. | 222/214 X |
| 4,428,232 | 1/1984 | Tanaka et al. . | |
| 4,957,220 | 9/1990 | Du . | |
| 5,353,963 | 10/1994 | Gorski et al. | 222/214 X |
| 5,401,139 | 3/1995 | Nabity et al. . | |
| 5,551,599 | 9/1996 | Niss | 222/214 X |
| 5,797,519 | 8/1998 | Schroeder et al. . | |
| 5,803,317 | 9/1998 | Wheller | 222/214 |
| 5,842,603 | 12/1998 | Schroeder et al. | 222/66 X |
| 5,875,930 | 3/1999 | Nakajima et al. | 222/214 X |
| 6,003,733 | 12/1999 | Wheller | 222/214 X |
| 6,016,935 | 1/2000 | Huegerich et al. | 222/214 X |

FOREIGN PATENT DOCUMENTS

| | | |
|---|---|---|
| 6-211299 | 8/1994 | Japan . |

*Primary Examiner*—Kenneth Bomberg
*Attorney, Agent, or Firm*—McDermott, Will & Emery

[57] ABSTRACT

In a beverage dispenser, a beverage material-supplying tube extending from BIB is squeezed by a pump to draw the beverage material from BIB and then to extrude the beverage material to a nozzle. The beverage dispenser has a sensor provided adjacent to the beverage material-supplying tube and a processor into which the output of the sensor is input. The sensor calculates a moving average value using, as a data source, highest signal values among sampled signals obtained by multipoint sampling of analog signals output from the sensor, and, based on the magnitude of a change in the moving average value, a decision is made on whether or not the beverage material has been sold out. By virtue of the above construction, the sold-out of the beverage material in BIB can be accurately detected.

4 Claims, 10 Drawing Sheets

BEVERAGE DISPENSER

FIELD OF THE INVENTION

The invention relates to a beverage dispenser for feeding a beverage material from BIB (Bag In Box).

BACKGROUND OF THE INVENTION

In conventional BIB beverage dispensers, for example, as described in Japanese Patent Laid-Open No. 211299/1994, a beverage material-supplying opaque tube extending from BIB is squeezed by a tube pump (a peristaltic pump) to draw the beverage material from BIB and then to extrude the beverage material via the beverage material-supplying tube to a nozzle, and, at the nozzle, is mechanically mixed with cooled water for dilution or cooled carbonated water.

According to these conventional beverage dispensers, when the BIB has become empty, that is, when the beverage material within the BIB has been sold out, the contemplated beverage no longer can be provided. Therefore, in this case, the empty BIB should be replaced with new BIB filled with the beverage material. In order to learn the sold-out of the beverage material within the BIB, a detector for sensing the sold-out state has hitherto been mounted in intimate contact with the beverage material-supplying tube. This detector senses, through an electrical factor, such as a magnetic field or an electrostatic capacitance, whether or not the beverage material is present or absent in the beverage material-supplying tube. A sensor in the detector outputs an analog signal as shown in FIG. 8.

FIG. 8 shows a change in an analog voltage output from the sensor over a period involving a change in the state of the beverage dispenser from a stand-by state to a beverage selling state. When the degree of a lowering (a difference) in the voltage output from the sensor has exceeded a predetermined threshold value, the detector decides that the beverage material has been sold out. In this case, the detector changes its output to indicate the sold-out state. The dispenser executes sold-out display and the like based on the change in output from the detector.

Since, however, the beverage material-supplying tube is squeezed by the pump, the occurrence of pulsation in the analog signal from the sensor is unavoidable as shown by large waves such as $W_1$, $W_2$, $W_3$ . . . rather than fine waves during selling (on sale) shown in FIG. 8. The straight solid lines $L_A$ and $L_B$ in FIG. 8 will be explained later in the preferred embodiment. For this reason, in the prior art, the signal change derived from the pulsation has often been erroneously regarded as a signal change derived from sold-out, leading to malfunction of the beverage dispenser.

In particular, as compared with low-viscosity beverage materials for teas and the like, in the case of high-viscosity beverage materials, for example, for orange juice, a change in analog signal created upon a change in the beverage dispenser from the selling state to the sold-out state is very small. Therefore, despite the fact that the beverage material is still present in the beverage material-supplying tube, there is a great fear of causing an erroneous decision to the effect that the beverage material has been sold out. Conversely, despite the fact that the beverage material has been sold out, there is a great fear of not making a decision to the effect that the beverage material has been sold out.

SUMMARY OF THE INVENTION

Accordingly, it is an object of the invention to provide a beverage dispenser which can accurately detect the sold-out of a beverage material within BIB.

According to the invention, a beverage dispenser, comprises:

- a pump for squeezing a beverage material-supplying tube to extrude a beverage material supplied from a BIB (Bag In Box) via said beverage material-supplying tube to a nozzle;
- a sensor provided outside said beverage material-supplying tube for generating an analog signal dependent on a condition of said beverage material inside said beverage material-supplying tube;
- means for sampling said analog signal at subsequent groups of sampling timings to generate said subsequent groups of sampled signals, and selecting group-highest values from said subsequent groups of sampled signals;
- a memory for subsequently storing said group-highest values; and
- a processor for calculating a moving average of said group-highest values, and determining a state of sold-out of said beverage material in said BIB in accordance with a change rate of said moving average.

According to the invention, in a beverage dispenser wherein a beverage material-supplying tube extending from BIB is squeezed by a tube pump to extrude and feed the beverage material, a sensor for outputting an analog signal dependent upon a condition within the beverage material-supplying tube is provided adjacent to the beverage material-supplying tube. Further, a processor is provided into which the output of the sensor is input. The processor calculates a moving average value using, as a data source, highest signal values among sampled signals obtained by multipoint sampling of analog signals output from the sensor, and, based on the magnitude of a change in the moving average value, a decision is made on whether or not the beverage material has been sold out. By virtue of the above constitution, an erroneous decision attributable to pulsation created by the operation of the pump can be prevented, realizing stable detection of the sold-out state.

In particular, since the decision is made based on the highest signal values, the magnitude of a change in analog signal output from the sensor can be clearly grasped, realizing enhancing the accuracy of the determination of the sold-out.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
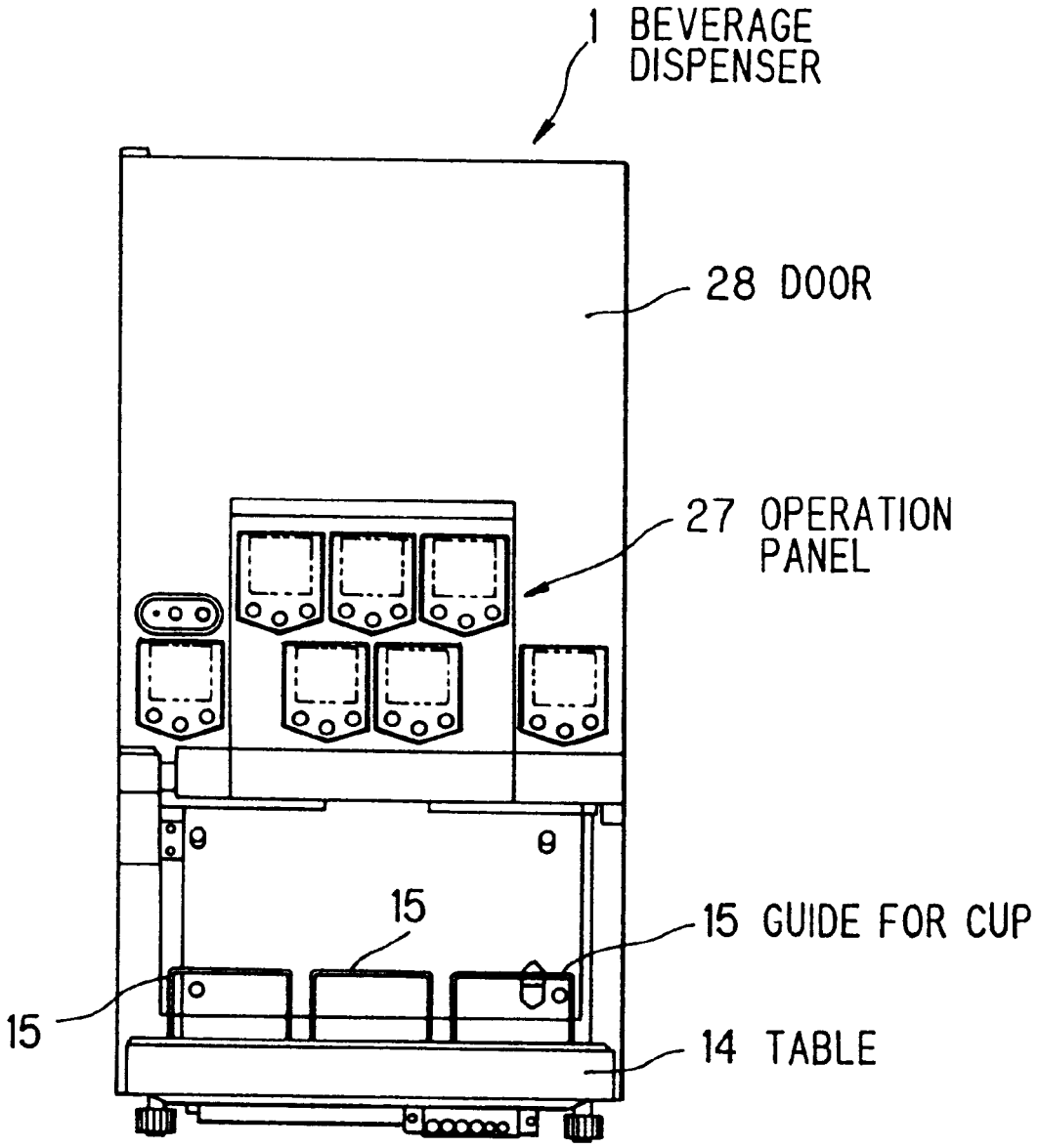
FIG. 1 is a front view of the beverage dispenser according to the invention.
Figure 2:
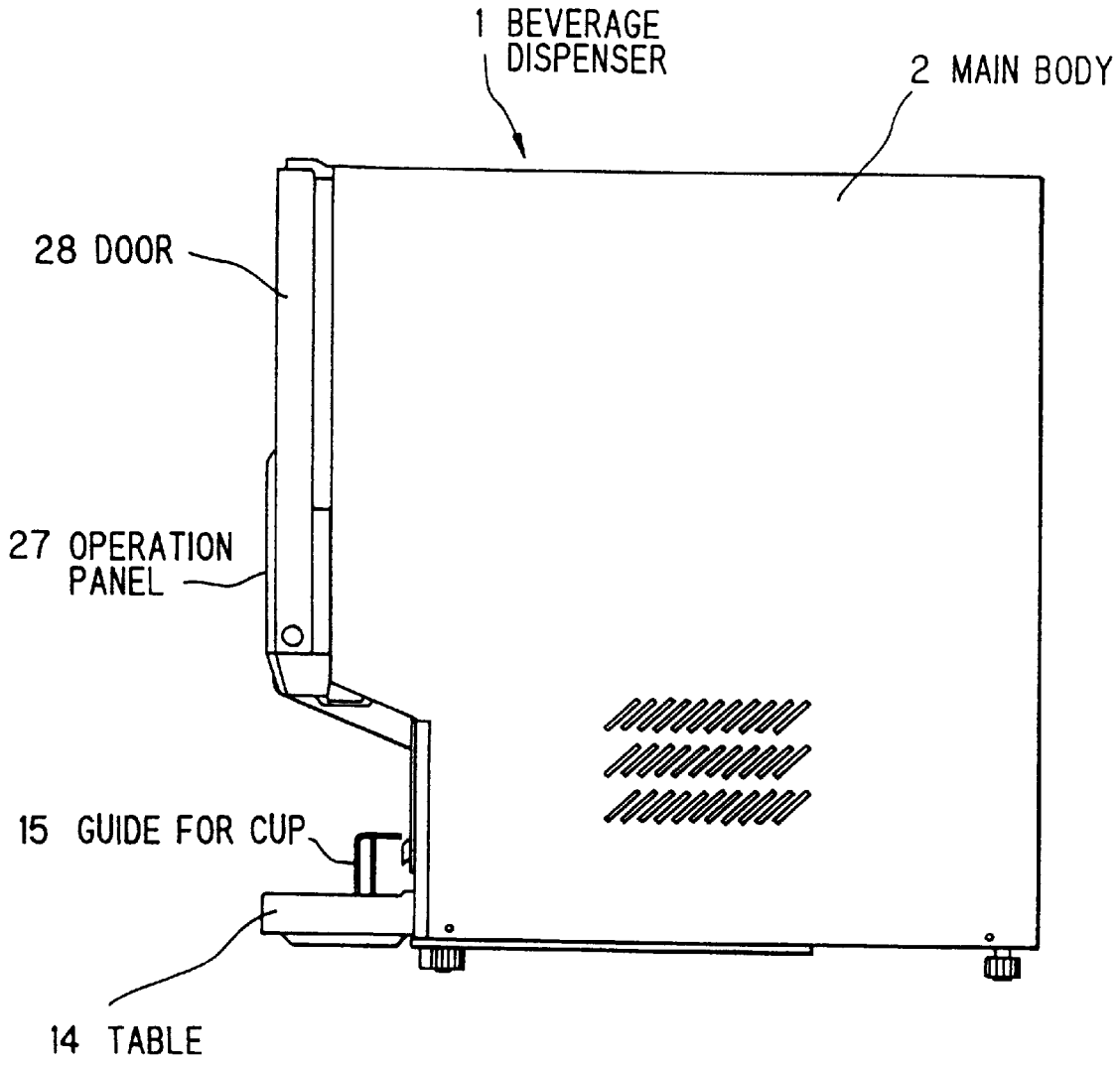
FIG. 2 is a side view of the beverage dispenser according to the invention.
Figure 3:
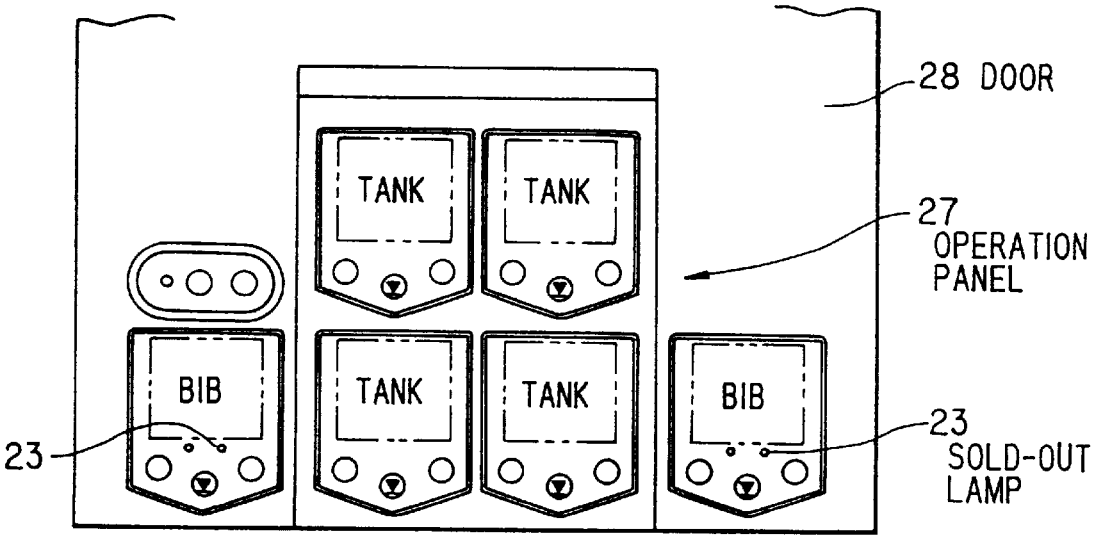
FIG. 3 is an enlarged view of the beverage dispenser, according to the invention, in its operating section.
Figure 4:
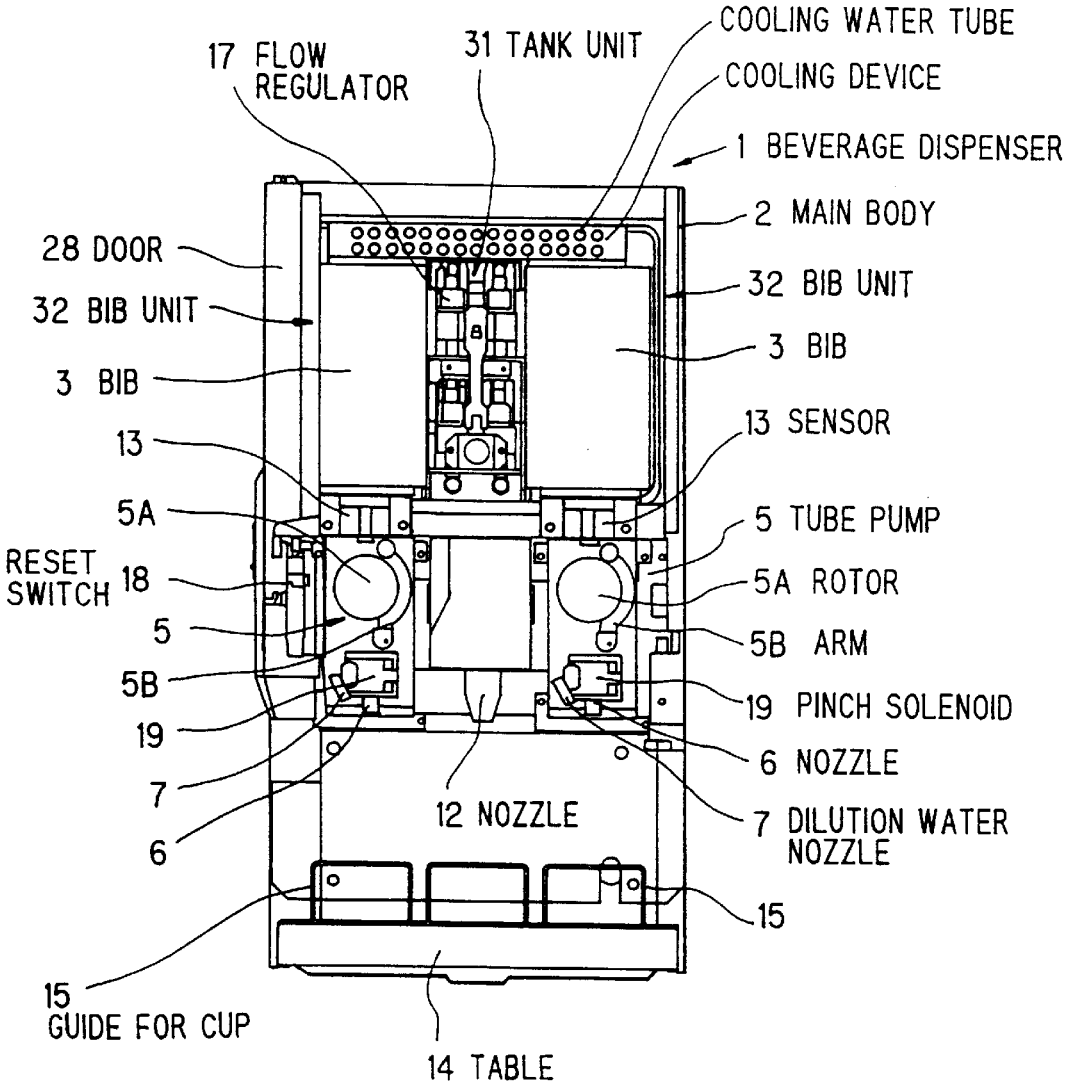
FIG. 4 is a front view of the beverage dispenser, according to the invention, with a door thereof being opened.
Figure 5:
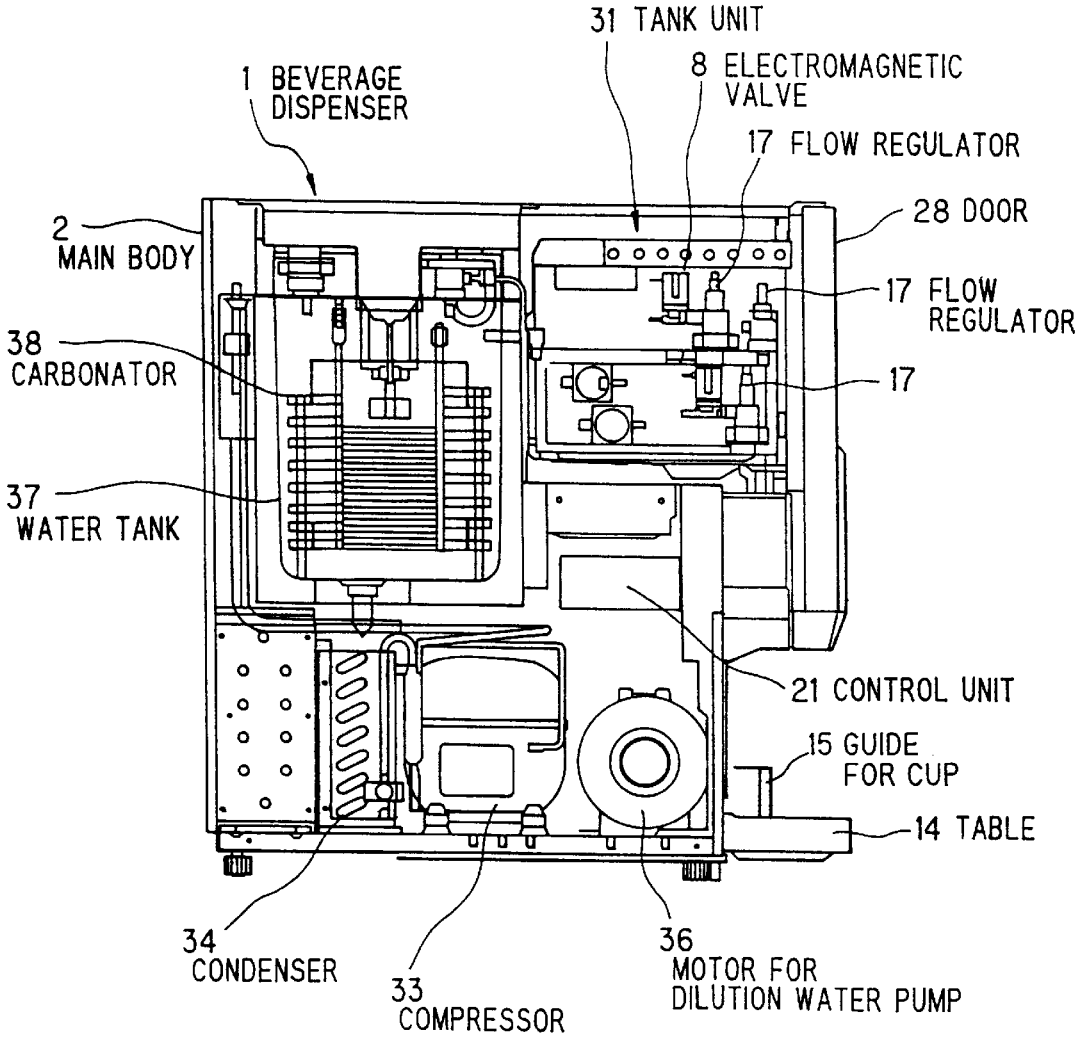
FIG. 5 is a side view showing the internal construction of the beverage dispenser according to the invention.
Figure 6:
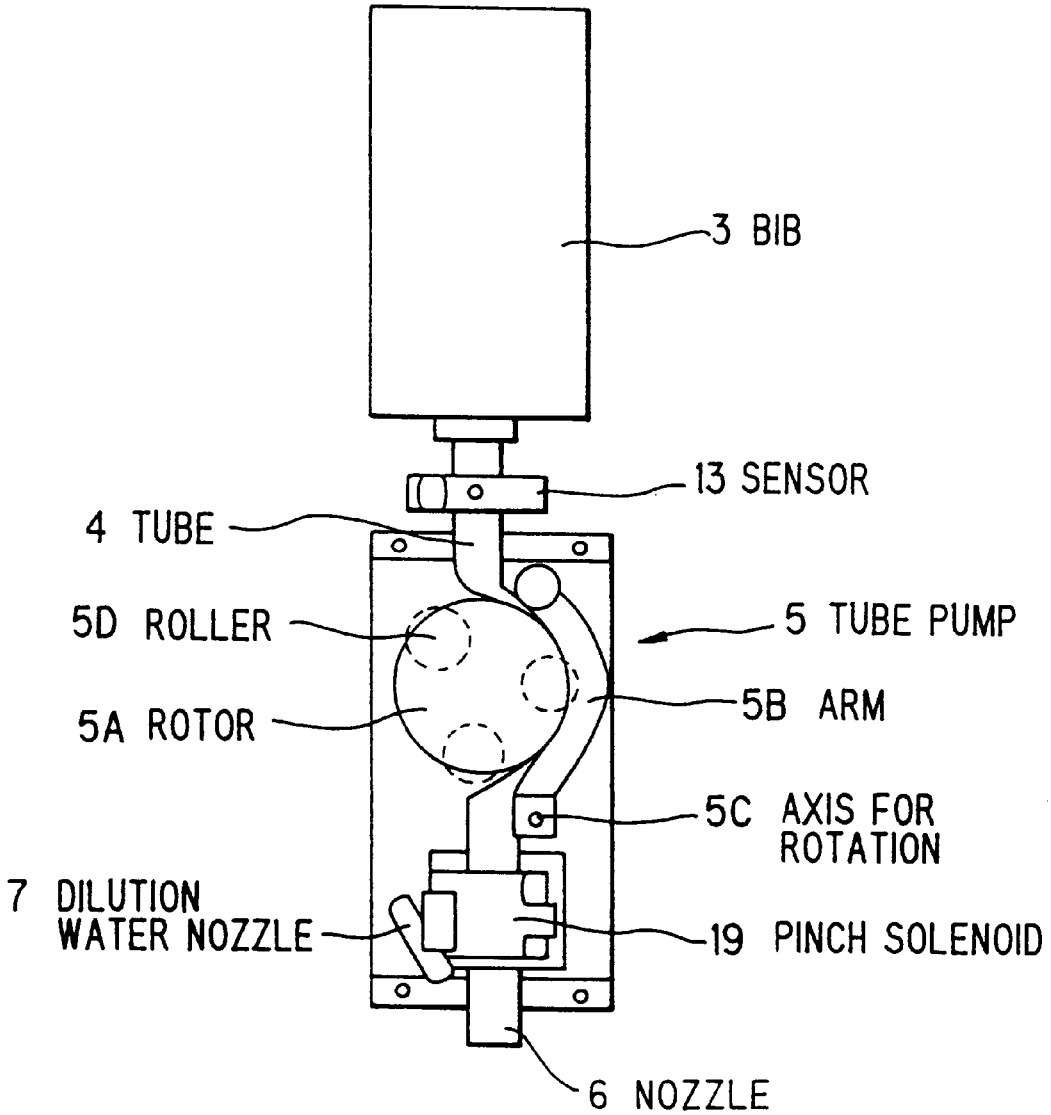
FIG. 6 is an enlarged front view of BIB, a sensor, and a pump shown in FIG. 4.
Figure 7:
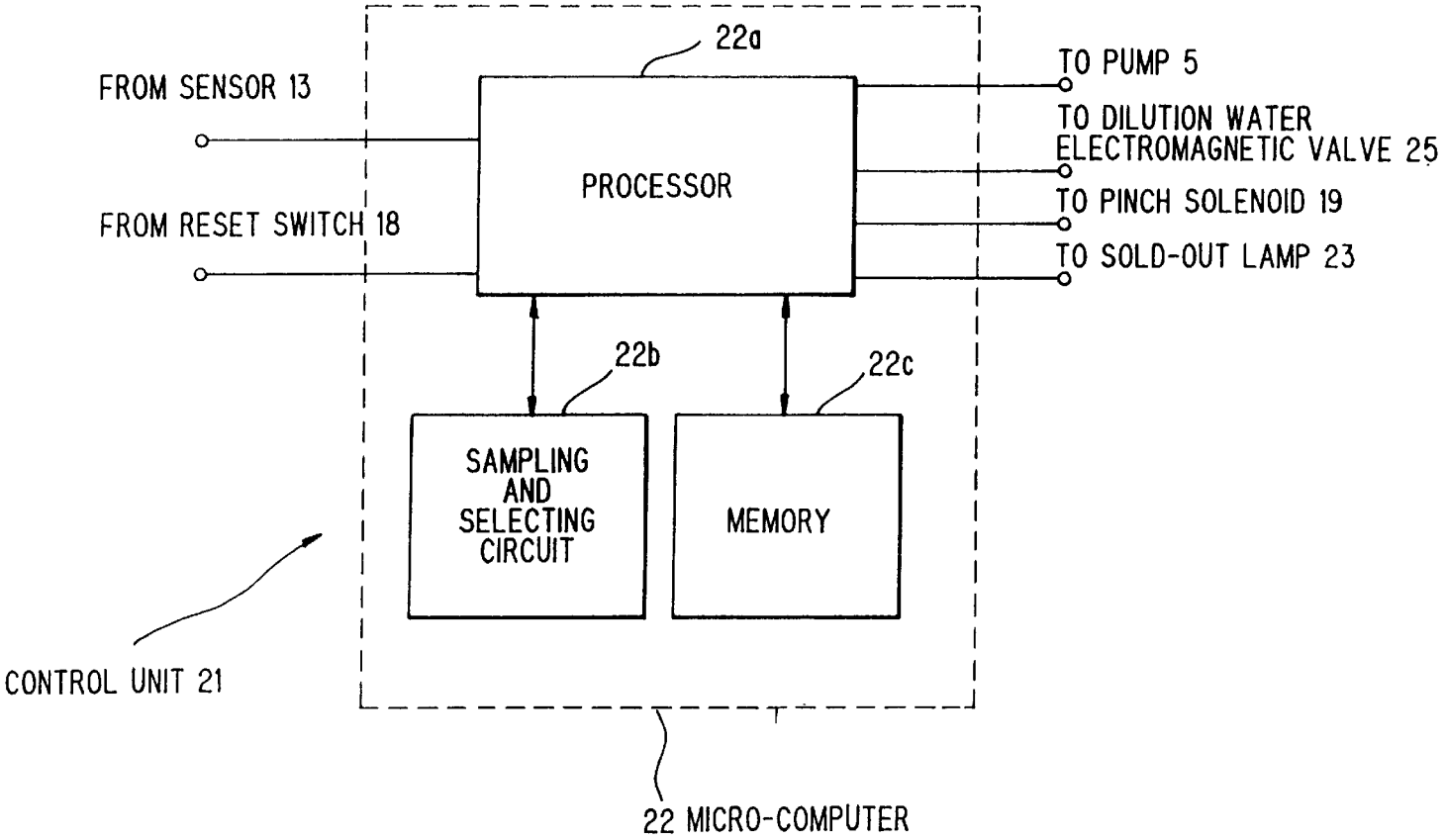
FIG. 7 is a block view of an electric circuit of a control unit in the beverage dispenser according to the invention.

FIG. 1 is a front view of a beverage dispenser 1 according to the invention, FIG. 2 a side view of a beverage dispenser 1 according to the invention, FIG. 3 an enlarged view of a beverage dispenser 1 in its operating section 27, FIG. 4 a front view of a beverage dispenser 1 with a door 28 thereof being opened, FIG. 5 a side view showing the internal construction of a beverage dispenser 1, FIG. 6 an enlarged front view of BIB 3, a sensor 13, and a pump 5 shown in FIG. 4, and FIG. 7 a block view of an electric circuit of a control unit 21 in a beverage dispenser 1.

The beverage dispenser 1 according to embodiments of the invention is a beverage dispenser for BIB used in restaurants, tearooms and the like. The beverage dispenser 1 comprises, in a main body 2, BIB units 32, for feeding neutral beverages, such as oolong tea and orange juice, in combination with a tank unit 31 for feeding contemplated strongly carbonated, weakly carbonated, and non-carbonated drinks. The structure of the beverage dispenser 1 is such that, as shown in FIG. 4, the tank unit 31 is disposed in the center portion and the BIB units 32, 32 are disposed respectively on both sides of the tank unit 31. The tank unit 31 and the BIB units 32, 32 are hidden by an openable door 28 located at the front face thereof.

As shown in FIGS. 4 and 5, the tank unit 31 comprises a solenoid valve 8 and a flow regulator 17 provided in a beverage material passage for feeding the beverage material. Further, the tank unit is provided with a nozzle 12 for ejecting a contemplated beverage prepared, in a mixer, by mixing the beverage material with dilution water fed through another tube. The nozzle 12 is a composite nozzle which ejects contemplated different beverages selected by users prepared from different beverage materials fed respectively from a plurality of beverage material tanks.

Next, the BIB unit 32 will be explained in FIGS. 4 and 6. A beverage material-supplying opaque tube 4 of BIB 3 passes a sensor 13 for sold-out detection and is supported in the state of sandwiching between a rotor 5A and an arm SB supported on an axis 5C for rotation in a pump (a peristaltic pump) 5. The beverage material is fed through a pinch solenoid 19 provided in a lower part of the pump 5 into a nozzle 6.

The pump 5 may be one disclosed, for example, in Japanese Patent Laid-Open No. 211299/1994. The pump 5 is such that a plurality of rollers 5D mounted on the rotor 5A successively squeeze the beverage material-supplying tube 4 to extrude the beverage material to the nozzle 6. Further, a nozzle 7 for dilution water is provided adjacent to the nozzle 6 for the beverage material.

A table 14 is provided below the nozzles 6, 7 in the BIB unit 32 and the nozzle 12 in the tank unit 31. A cup guided by a guide 15 may be placed on the table 14. In FIG. 5, numeral 33 designates a compressor constituting a cooling device for cooling dilution water and the like, numeral 34 a condenser, numeral 36 a motor for a dilution water pump, numeral 37 a water tank, and numeral 38 a carbonator.

On the other hand, the sensor 13 is provided adjacent to and in intimate contact with the beverage material-supplying tube 4. This sensor 13 generates from its core a magnetic field within the beverage material-supplying tube 4, and outputs, as an analog signal (voltage) , a change in magnetic field, created by a difference in magnetic permeability between the beverage material passed through the beverage material-supplying tube 4 and air bubbles.

An operation panel 27 for operating the feed of the beverage from the tank unit 31 and the BIB units 32, 32 is provided on the front of the door 28. In particular, sold-out lamps 23 are provided on the operation panel 27 in its portions corresponding to the BIB units 32, 32. Further, a reset switch 18 for performing resetting with respect to the sold-out state upon replacement of BIB, with the beverage material being sold out, by new BIB filled with the beverage material is provided on the backside of the door 28.

FIG. 7 shows a control unit 21 associated with BIB in the beverage dispenser 1. The output of the sensor 13 and the output of the reset switch 18 are input into a micro-computer 22 in the control unit 21. The output of the micro-computer 22 is connected to the sold-out lamp 23, the pinch solenoid 19, the pump 5, and the solenoid 25 for dilution water. The micro-computer 22 comprises a processor 22*a*, a sampling and selecting circuit 22*b*, and a memory 22*c*.

Figure 8:
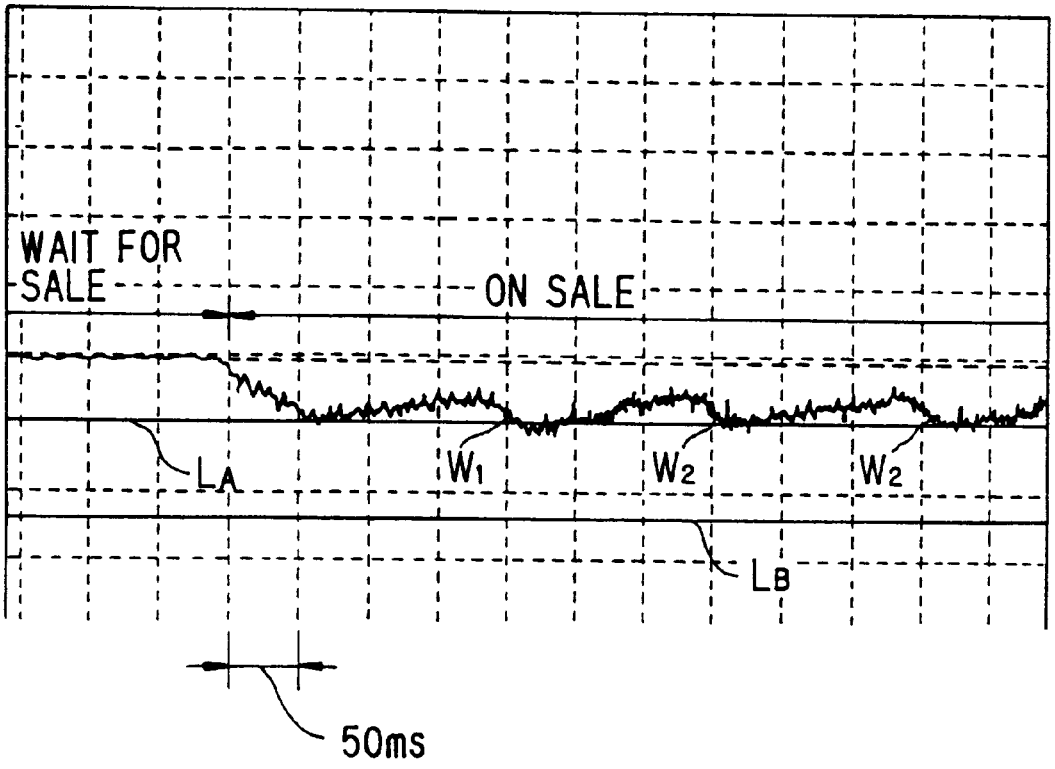
FIG. 8 is a diagram showing an analog signal output from a sensor in the beverage dispenser according to the invention.
Figure 9:
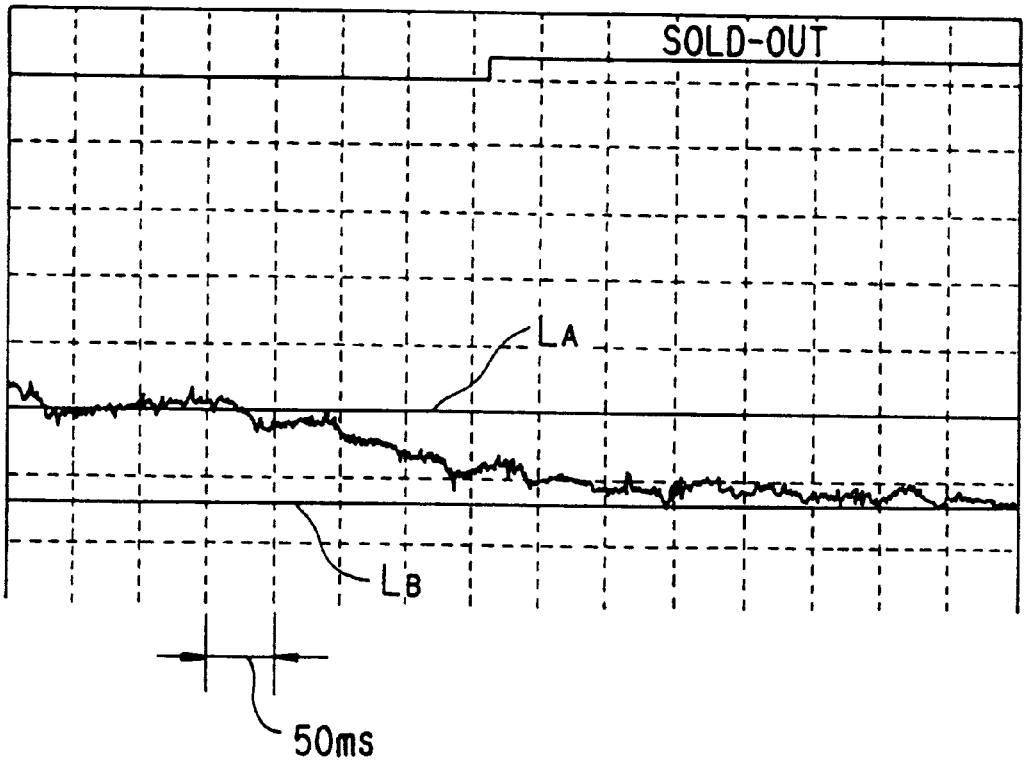
FIG. 9 is a diagram showing an analog signal output from the sensor in the beverage dispenser according to the invention.
Figure 10:
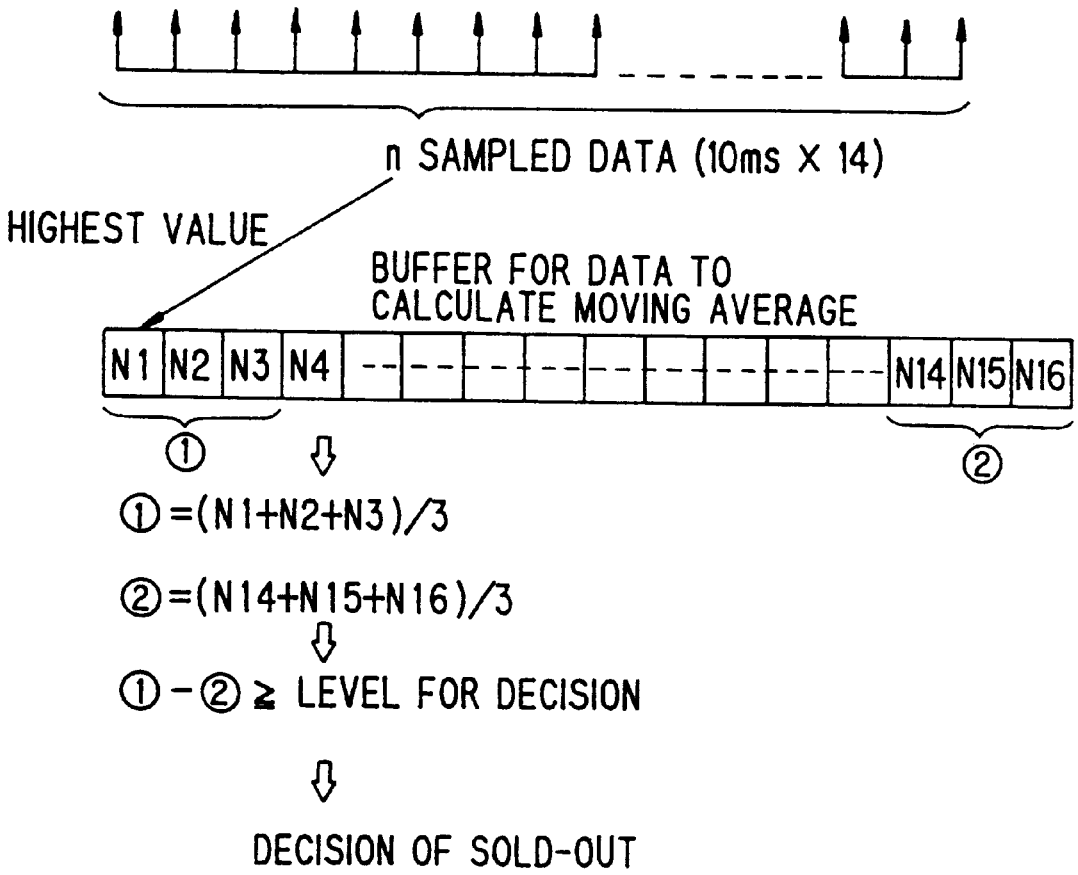
FIG. 10 is a flow diagram showing the operation on a decision of sold-out of a micro-computer in a control unit of the beverage dispenser according to the invention.

The BIB-related operation of the beverage dispenser 1 in the above construction will be explained with reference to FIGS. 8 to 10. FIGS. 8 and 9 show analog signals output from the sensor 13 over a period involving a change of the beverage dispenser from the stand-by state to the beverage selling state, in which the levels $L_A$ and $L_B$ in FIG. 8 are equal to the levels $L_A$ and $L_B$ in FIG. 9, respectively. The level of signals from the sensor 13 remains unchanged during the stand-by period. Upon the start of selling of the beverage from BIB 3, the processor 22*a* drives the pump 5 during a preset selling time, and, in addition, open the solenoid 25 for dilution water to eject dilution water. Upon the elapse of the predetermined selling time, the pump 5 is stopped, the solenoid 25 for dilution water is closed, and the pinch solenoid 19 is closed.

Thus, the beverage material in an amount determined by the selling time is diluted with the dilution water to feed a predetermined concentration of the neutral beverage into the cup.

As described above, pulsation as shown in FIG. 8 appears in the level of signals from the sensor 13 during selling. This is attributable to vibration of the beverage material-supplying tube 4, a variation in ejection of the beverage material or other phenomena created by squeezing the pump 5.

On the other hand, the processor 22*a* gives the sampling and selecting circuit 22*b* an instruction for multipoint sampling (n samples, for example, 14 samples) of analog signals from the sensor 13 at predetermined intervals (for example, 10 ms). The highest value in the first group of collected n samples is selected, and is stored as data N1 in a data source buffer for moving average in the memory 22*c* provided in the micro-computer 22*a*. In this way, 16 highest values (N1–N16) are stored. Next, when a new highest value in selected, the current N1 is discarded, N2 is transferred to N1, and the new highest value is stored as N16. Thus, the data is sequentially updated. This state is shown in FIG. 10.

Every time when the data in the buffer has been updated, the processor 22*a* calculates the average of the first three data N1, N2, and N3 to obtain data , and calculates the average of the last three data N14, N15, and N16 to obtain data. The difference between the data and the data, that is,–, is then determined to obtain a change in moving average value. A decision is successively made on whether or not this change (difference) has exceeded a predetermined level for decision. When the change (difference) has exceeded the predetermined level, a decision is made to the effect that the beverage material has been sold out.

By virtue of the provision of the criteria for the decision, even when pulsation appears in the output from the sensor 13 during selling as shown in FIG. 8, the highest values are nearly even. Therefore, when the beverage material is present in BIB 3, the difference (–) does not exceed the predetermined level for decision.

Next, when the beverage material within BIB 3 is sold out during selling, air bubbles are included in the beverage material-supplying tube 4. As a result, the analog signal from the sensor 13 is rapidly and largely lowered between the levels $L_A$ and $L_B$ shown in FIG. 9. During this period as well, the above decision is successively made by the processor 22*a*. Upon a rapid lowering in analog signal to bring the difference (–) to a level greater than the decision level, a decision is made to the effect that the beverage material in BIB 3 has been sold out. Upon this decision, the sold-out lamp 23 is turned on.

In this connection, when the sold-out BIB 3 is replaced, the arm SB is opened to remove the beverage material-supplying tube 4, followed by setting of a beverage material-supplying tube 4 of a new BIB 3 between the rotor 5A in the tube pump 5 and the arm 5B. The operation of a reset switch 18 permits the processor 22*a* to reset the decision of sold-out.

In the above embodiments, the sensor 13 is used for detecting a condition within the beverage material-supplying tube 4 by means of a magnetic field. The detection means is not limited to the sensor, and detection using an electrostatic capacitance is also effective in the invention. Further, the number of moving average data is not limited to that described in the above embodiments, and may be properly varied.

As is apparent from the foregoing description, in a beverage dispenser wherein a beverage material-supplying tube extending from BIB is squeezed by a tube pump to extrude and feed the beverage material, a sensor for outputting an analog signal dependent upon a condition within the beverage material-supplying tube is provided adjacent to the beverage material-supplying tube. Further, a processor is provided into which the output of the sensor is input. The processor calculates a moving average value using, as a data source, highest signal values among sampled signals obtained by multipoint sampling of analog signals output from the sensor, and, based on the magnitude of a change in the moving average value, a decision is made on whether or not the beverage material has been sold out. By virtue of the above constitution, an erroneous decision attributable to pulsation created by the operation of the pump can be prevented, realizing stable detection of the sold-out state.

In particular, since the decision is made based on the highest signal values, the magnitude of a change in analog signal output from the sensor can be clearly grasped, realizing enhancing the accuracy of the determination of the sold-out.

The invention has been described in detail with particular reference to preferred embodiments, but it will be understood that variations and modifications can be effected within the scope of the invention as set forth in the appended claims.

What is claimed is:

1. A beverage dispenser, comprising:

a pump for squeezing a beverage material-supplying tube to extrude a beverage material supplied from a BIB (Bag In Box) via said beverage material-supplying tube to a nozzle;

a sensor provided outside said beverage material-supplying tube for generating an analog signal dependent on a condition of said beverage material inside said beverage material-supplying tube;

means for sampling said analog signal at subsequent groups of sampling timings to generate said subsequent groups of sampled signals, and selecting group-highest values from said subsequent groups of sampled signals;

a memory for subsequently storing said group-highest values; and a processor for calculating a moving average of said group-highest values, and determining a state of sold-out of said beverage material in said BIB in accordance with a change rate of said moving average.

2. The beverage dispenser as defined in claim 1, wherein:

said processor comprises a comparator for comparing a difference between first and second moving averages with a predetermined level to determine said state of sold-out.

3. The beverage dispenser as defined in claim 2, wherein;

said processor calculates said first and second moving averages in accordance with first and second groups of group-highest values, said second group of group-highest values being sequentially separated from said first group of group-highest values by one or more group-highest values.

4. The beverage dispenser as defined in claim 1, wherein:

said sensor generates said analog signal by detecting a magnetic field or an electrostatic capacitance of said beverage material-supplying tube.

* * * * *